US006162502A

United States Patent [19]

Schweizer et al.

[11] Patent Number: 6,162,502

[45] Date of Patent: Dec. 19, 2000

[54] METHOD AND DEVICE FOR CURTAIN COATING A MOVING SUPPORT

[75] Inventors: Peter M. Schweizer, Wünnewil; Urs Troller, Trimbach, both of Switzerland

[73] Assignee: Troller Schweizer Engineering AG, Switzerland

[21] Appl. No.: 09/165,688

[22] Filed: Oct. 2, 1998

[30] Foreign Application Priority Data

Oct. 3, 1997 [EP] European Pat. Off. ..... 97810732

[51] Int. Cl.[7] ..... B05D 1/30

[52] U.S. Cl. ..... 427/294; 427/420; 118/324

[58] Field of Search ..... 118/325, 324, 118/DIG. 4; 427/420, 348, 294

[56] References Cited

U.S. PATENT DOCUMENTS 4,842,900 6/1989 Miyamoto ..... 427/348
5,624,715 4/1997 Gueggu et al. .

FOREIGN PATENT DOCUMENTS 0440279 8/1991 European Pat. Off. .
0489978 6/1992 European Pat. Off. .
0704752 4/1996 European Pat. Off. .

*Primary Examiner*—Kevin Weldon
*Attorney, Agent, or Firm*—Ostrolenk, Faber, Gerb & Soffen, LLP

[57] ABSTRACT

In the method for curtain coating a moving support with any kind of coating solution, the air which is carried along by the moving support is extracted in front of the curtain as seen in the running direction of the support in a gap which extends concentrically to the support, and air is continuously supplied in a controlled manner. In the process, the supplied air is regulated in function of the extracted air in such a manner that a parabolic velocity profile develops which comprises a point P at a distance d from the support where the air velocity is equal to zero. In the device implementing the method, this adjustment is essentially enabled by a porous layer which is disposed on the support side in a cavity to which a suction resp. an air supply channel is connected. In this manner, a uniform coating of high quality can be obtained.

9 Claims, 3 Drawing Sheets

METHOD AND DEVICE FOR CURTAIN COATING A MOVING SUPPORT

FIELD OF THE INVENTION

The present invention refers to a method for curtain coating a moving support with a coating material where the air which is carried along by the moving support is extracted in front of the curtain as seen in the running direction of the support in a gap which extends in parallel or concentrically to the support, and air is continuously supplied in a controlled manner. The invention further refers to a device for carrying out the method which comprises a coating roll for the purpose of guiding a support, and a suction and an air supply device which in the direction of motion of the support are disposed in front of the curtain and are provided on a body which forms a gap and extends in parallel or concentrically to the support. In the context of the invention, any kind of coating material may be concerned.

BACKGROUND OF THE INVENTION

In all coating methods, and especially in the curtain coating method, problems are created by the air which is carried along to the coating point by the uncoated support due to friction. The coating point designates the location where the coating liquid first contacts the support. In many coating methods, and also in the curtain coating process, this location has the form of a line and is referred to as the dynamic wetting line. The area near the support where the air is in motion due to friction is called the boundary layer.

In the curtain coating process, the following problems with respect to the air boundary layer are known:

Coating means replacing the air on the support by a liquid. If this cannot be achieved, which may be the case mainly at increased coating speeds, air is entrained between the support and the liquid film, and a coherent coating is no longer possible.

Yet, even if the air is not entrained between the support and the liquid film, it strikes the back of the curtain, seen in the direction of motion of the support, with a considerable force, especially in the case of high coating speeds. This leads to disturbances, mainly in the area of the dynamic wetting line, which cause diffuse irregularities in the coated film.

In one way or another, the air which is carried against the front side of the curtain by the support must be removed, namely sideways, upwards, backwards, but not in the direction of motion of the support. Especially in the case of wide supports, this removal of the air creates problems whereby the curtain is blown up in the direction of motion of the support like a balloon. On one hand, a deformation of the curtain results, whereby the quality of the coated film may be impaired, and on the other hand, a deformation of the dynamic wetting line. This results in an irregular coating behavior of the curtain transversely to the coating direction, which may again impair the quality of the coated film, e.g. in the form of air inclusions in the marginal areas of the curtain.

Different methods and devices have been developed in order to eliminate or at least reduce the negative effects described above. In the method and the device according to the preamble of claims 1 and 3, i.e. according to U.S. Pat. No. 5,624,715, on one hand, the boundary layer is blocked by a body which is disposed in front of the curtain as seen in the direction of motion of the support and at a small distance from the coating roll, and on the other hand, the air which flows through the gap created between the body and the support is extracted by a slit nozzle while air is supplied at this location in a controlled manner.

Also, according to EP-B-0 489 978, a shield which is disposed concentrically around the coating roll is used in order to mechanically stop the boundary layer. Additionally, in this case, the air flowing through the concentric gap is extracted in the center of the body.

The main effect of both methods described above is based upon the mechanical obstruction of the air boundary layer. Although air is additionally extracted in both devices, a considerable amount of air still strikes the back side of the curtain, so that losses in quality as described above may still occur.

In both apparatus, the design of the suction device, in particular, is ineffective due to its slit configuration. According to EP-B-0 489 978, a relatively large chamber is additionally provided between the suction slit and the concentric gap where the air is strongly swirled, so that the residual air strikes the curtain with irregular forces in the direction transversely to the movement of the support and may thus cause losses in quality. Moreover, since the suction device is disposed at the center of the body, the air is aspired from the space between the body and the curtain to the concentric gap in opposition to the movement of the support. In front of the curtain and particularly near the dynamic wetting line, this suction creates an additional air flow which is irregular transversely to the movement of the support and which may therefore result in a loss in quality of the coated film.

SUMMARY OF THE INVENTION

On the background of this prior art, it is the object of the present invention to provide a method and device which allow an improved uniformity of the coated film. This object is attained by a method wherein the air supply is adjusted in function of the extracted air in such a manner that a parabolic velocity profile develops which comprises a point P at a distance d from the support where the air velocity is equal to zero, and by a device wherein said body, seen in the running direction of said support, comprises a first cavity provided with a following air suction channel and, before the end of said body, a second cavity connected to an air supply channel, both of said cavities extending across the entire width of said support and being provided on their support sides with a layer of a porous material in such a manner that a uniform, concentric or parallel gap is formed between said support and said body. Further improvements and advantages result from the dependent claims.

BRIEF DESCRIPTION OF THE DRAWINGS

The invention is explained in more detail hereinafter with reference to a drawing of an embodiment.

DETAILED DESCRIPTION OF THE INVENTION

Figure 1:
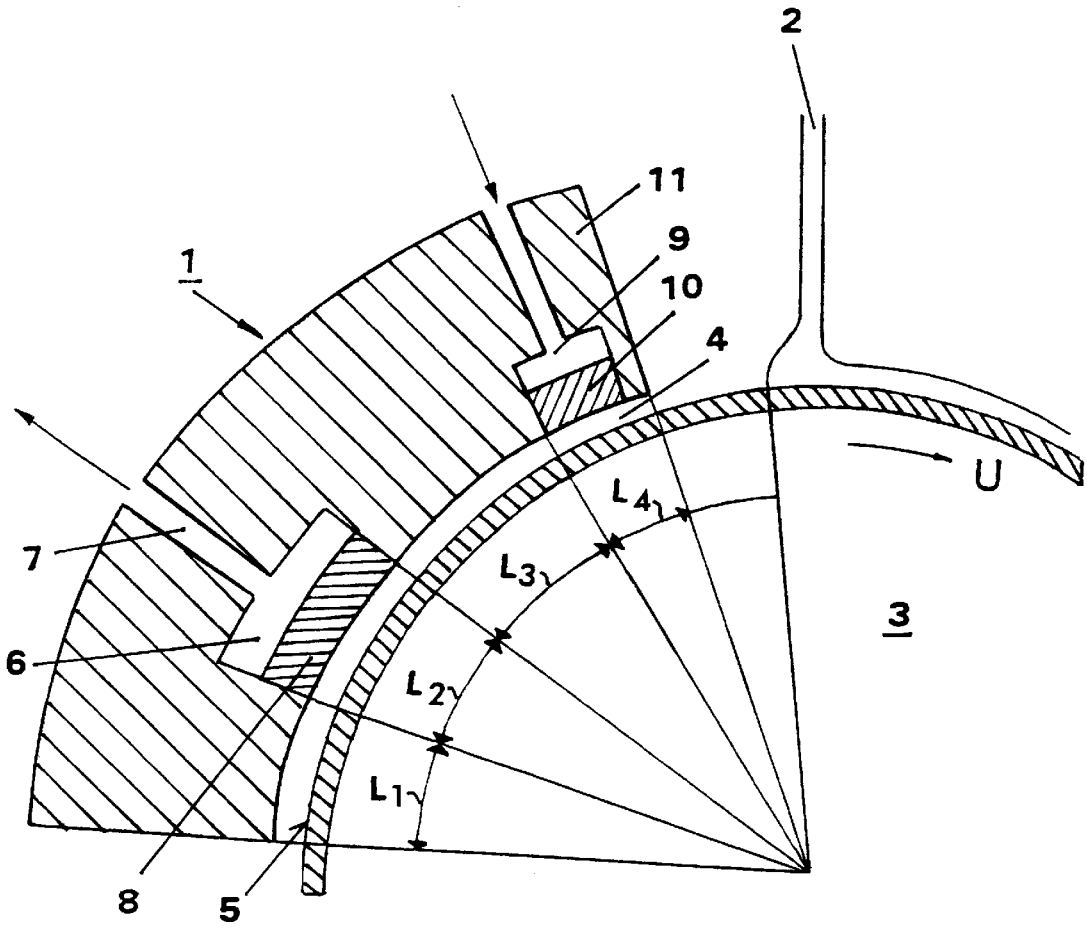
FIG. 1 shows a cross-section of the device of the invention.

The following description refers to a consideration in the direction of motion of the support, which is indicated by an arrow U in FIG. 1. The device of the invention comprises a body 1 which extends concentrically around coating roll 3 in front of curtain 2 and thereby forms a uniform gap 4 between the support surface 5 and body 1 whose height H is comprised between 0.1 and 1.0 mm, preferably between 0.3 and 0.6 mm. The first half of the body comprises a first cavity 6 which extends across the entire width of the support surface and communicates with a suction channel 7. The suction channel is connected to a suction device known per se.

On the support side, the first cavity 6 contains a first layer 8 of a porous material through which the air is removed. The cavity remaining behind the porous layer contributes to an effective and uniform extraction of the air over the entire length $L_2$ and across the entire width of the porous layer. The length $L_2$ amounts to 15 mm, for example.

A second section of the body holds a second cavity 9 which is also provided on the support side with a layer 10 of a porous material and is connected to an air supply channel 11, for a uniform supply of air instead of its extraction through this second porous layer. The uniformity of the air supply transversely to the movement of the support over a length $L_4$ also results from the cavity behind the porous layer. The air supply channel is connected to a non-represented air supply device allowing to precisely adjust the pressure and thus the volume flow of the supplied air.

The lengths $L_1$ and $L_3$ of the body in front and behind the first porous layer are so dimensioned that a fully developed flow is created in concentric gap 4. The minimal lengths for $L_1$ and $L_4$ mainly depend on the support speed and the gap height and are comprised between approx. 3 to 15 mm for a speed of 5 m/s and a gap height of 0.5 mm.

Figure 2:
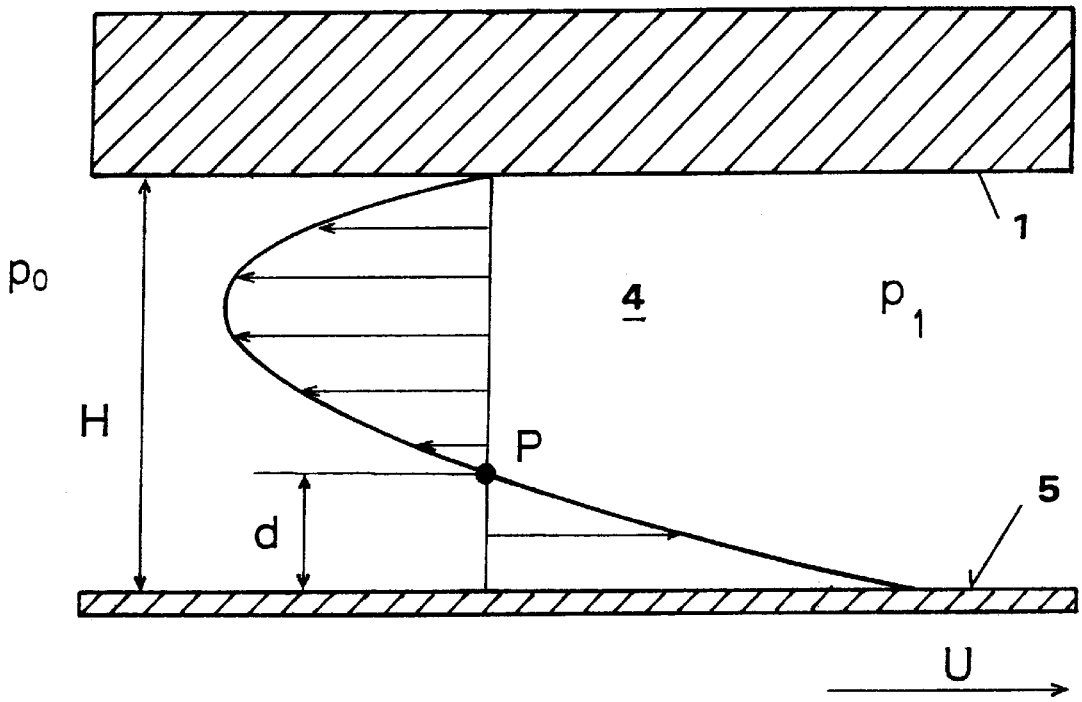
FIG. 2 shows the velocity profile in the gap.

Due to the supplied air, a regulated air flow toward the curtain develops in the gap between the first porous layer and the gap end which is characterized by a parabolic velocity profile such that the air flows along the body from the curtain toward the first porous layer in the upper part of the gap and along the support web toward the curtain in the lower part of the gap, see FIG. 2.

The layer thickness of the porous layers depends on the porosity and the specific surface area of the porous material, amongst other things. The layer thickness must be so dimensioned that the pressure drop of the air flow through the porous layer is substantially greater, i.e. 100 times greater, for example, than the pressure drop of the air flow transversely to the movement of the support in the channel behind the porous layer. For a porosity of 0.4 and a support width of 1 m, a layer thickness of approx. 8 mm results.

The velocity profile in the concentric gap between the porous layers, along $L_3$, distinguishes itself by the point P which is located at a distance d from the support surface. The air velocity at the point P is zero, i.e. the point P separates the forward flow, in the direction of motion of the support, from the backward flow. The velocity profile u(y) of a flow having this configuration is calculated according to the Hagen-Poiseuille formula as follows:

$$u(y) = \frac{(p_1 - p_0)}{2\mu L} y^2 - \left[\frac{(p_1 - p_0)H}{2\mu L} + \frac{U}{H}\right] y + U \tag{1}$$

where u(y)=air velocity in the gap $P_1$=ambient pressure behind the curtain $P_0$=vacuum at the suction device $\Delta_p$=pressure difference=$(p_1-p_0)$ $\mu$=air viscosity L=gap length H=gap height U=support speed y=coordinate perpendicular to the support surface.

The distance d is calculated according to $$d = -\frac{a}{2} - \sqrt{\left(\frac{a}{2}\right)^2 - b} \text{ while} \tag{2}$$

$$a = -\left[H + \frac{2\mu LU}{\Delta p H}\right] \text{ and}$$

$$b = \frac{2\mu LU}{\Delta p}$$

Figure 3:
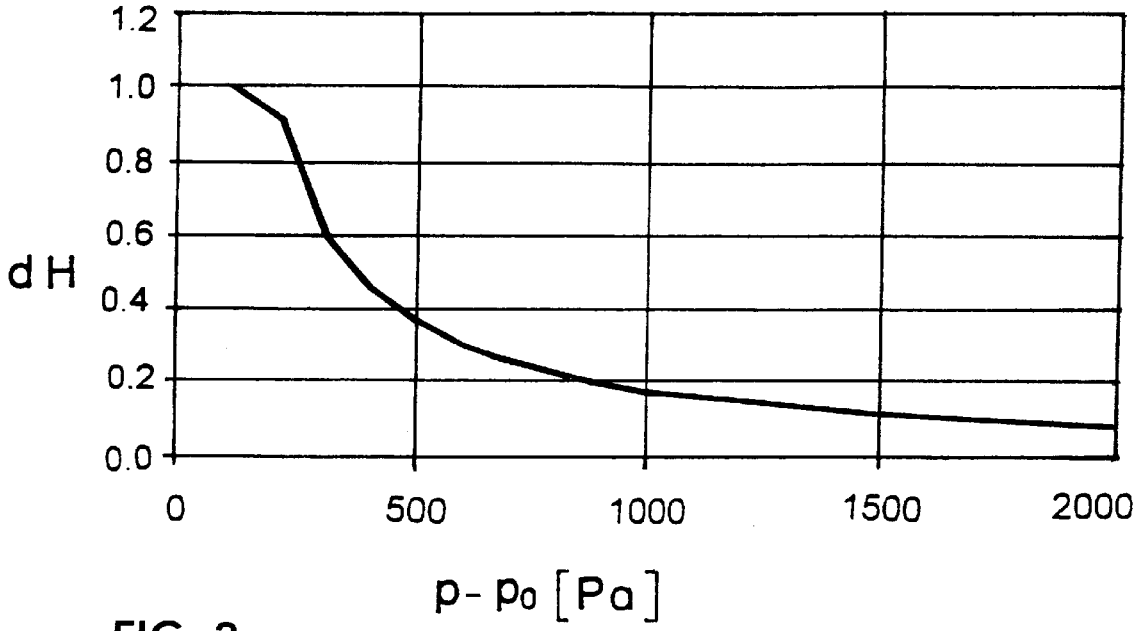
FIG. 3 shows the location where the velocity of the gap flow is zero.

In FIG. 3, the distance d, which is normalized with respect to the gap height H, is represented as a function of the pressure difference Δp, whereby the location of zero velocity is obtained.

Integration of the velocity profile over the gap height H yields the air volume flow/gap width $Q_1$ impinging on the curtain as well as the volume flow/gap width $Q_2$ to be extracted:

$$Q_1 = \frac{\Delta p}{2\mu L}\frac{d^3}{3} - \left[\frac{\Delta p H}{2\mu L} + \frac{U}{H}\right]\frac{d^2}{2} + Ud \tag{3}$$

$$Q_2 = \frac{\Delta p}{2\mu L}\left(\frac{H^3}{3} - \frac{d^3}{3}\right) - \left[\frac{\Delta p H}{2\mu L} + \frac{U}{H}\right]\left(\frac{H^2 - d^2}{2}\right) + U(H - d) \tag{4}$$

Figure 4:
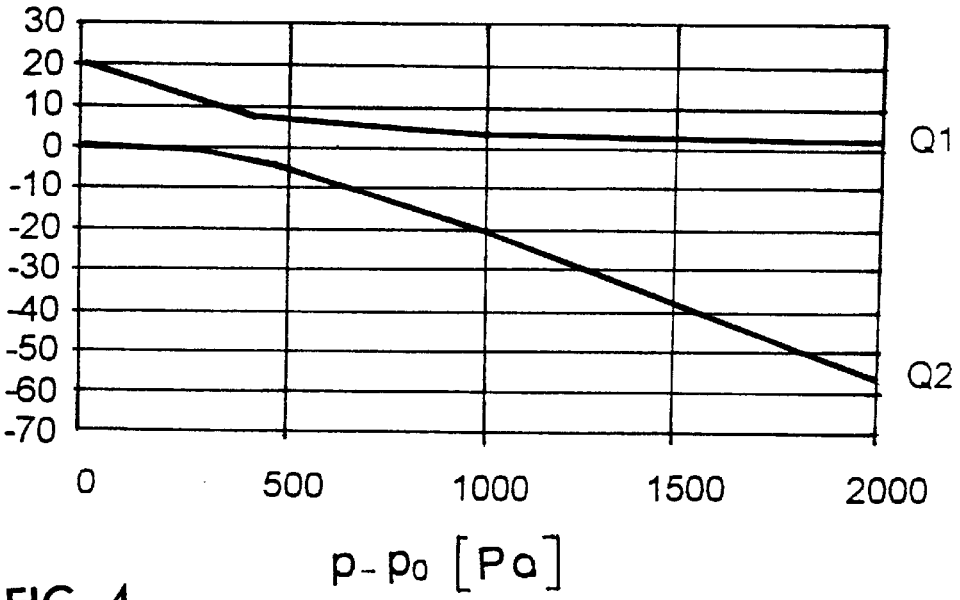
FIG. 4 shows the volume flows of the gap flow.

The two volume flows are represented as a function of the pressure difference Δp in FIG. 4.

For a given gap height, the air volume impinging on the curtain and the corresponding air volume to be extracted can be regulated as desired by adjusting the vacuum $p_0$. More particularly, it may be adjusted to be indefinitely small, which allows to minimize the influences acting upon the curtain which are responsible for losses in quality. In this context, it is important that the air volume to be extracted is not drained from the space between the curtain and the body, thus causing disturbing air flows in front of the curtain, but that the correct air volume is supplied through the porous layer at the outlet of the gap in such a manner that no disturbing air flows are created in front of the curtain nor in the gap. Moreover, only the air volume $Q_1$ which flows through the gap toward the moving support and impinges on the curtain must be extracted from the space between the curtain and the body.

We claim:

1. A device for curtain coating a moving support with a coating material and for extracting air carried along by the support in front of the curtain, the device comprising:

a moving support having a surface on which the curtain is coated and movable in a running direction past a curtain of coating material applied to the surface at a curtain application location along the running direction of the support, the support having a lateral width across the running direction;

a combination air supply device and suction device located in front of and upstream of the curtain application location along the running direction, and comprising:

a body supported in position to define a gap with respect to and being spaced from the surface of the support;

the suction device being located upstream in the body along the running direction and open to the gap and comprising an air suction channel; the air supply device being located downstream along the body and also open to the gap and comprising an air supply channel; the body being shaped so that the air suction channel and the air supply channel extend across the lateral width of the support;

a respective layer of porous material being provided in each of the air supply channel and the air suction channels at the gap.

2. The device of claim 1, wherein the body has a side in the gap and the side of the body toward the gap is parallel to the support surface moving past the gap.

3. The device of claim 1, wherein the support includes a rotatable coating roll and the support being guided on the roll; the body having a side facing into the gap and the side of the body being concentric with the support surface moving past the gap.

4. The device of claim 3, wherein the air supply channel ends in a cavity, the porous material is in the cavity and the porous material faces into the gap in a manner so that the porous material is parallel with the side of the body at the gap;

the air suction channel ends in a cavity, the porous material is in the cavity and the porous material faces into the gap in a manner so that the porous material is parallel with the side of the body at the gap.

5. The device of claim 1, wherein the height of the gap is between 0.1 and 1.0 mm.

6. The device of claim 1, wherein the height of the gap is between 0.3 and 0.6 mm.

7. The device of claim 4, wherein the body has a length along the advancing direction, the body has a starting location along the advancing direction, the upstream cavity has a starting point and a terminating point in the advancing direction and the downstream cavity has a starting point and a terminating point in the advancing direction, and the terminating point of the downstream cavity is before the end of the body in the running direction;

there is a minimum length between the beginning of the body in the running direction and the beginning of the upstream cavity in the running direction and there is a minimum length between the termination end of the upstream cavity and the beginning end of the downstream cavity, and those minimum lengths are both within the range of 3 to 15 mm.

8. A method of operation for device for curtain coating a moving support with a coating material and for extracting air carried along by the support in front of the curtain, the device comprising:

a moving support having a surface on which the curtain is coated and movable in a running direction past a curtain of coating material applied at a location along the running direction of the support; the support having a lateral width across the running direction;

a combination air supply device and suction device located in front of and upstream of the curtain application location along the running direction and comprising:

a body supported in position to define a gap with respect to and being spaced from the surface of the support;

the suction device being located upstream in the body along the running direction and open to the gap and comprising an air suction channel; the air supply device being located downstream along the body and also open to the gap and comprising an air supply channel; the body being shaped so that the air suction channel and the air supply channel extend across the entire width of the support;

a respective layer of porous material being provided in each of the air supply channels and the air suction channel at the gap;

the method of operation of the device comprising:

moving the support surface in the advancing direction;

continuously supplying air in a controlled manner to the air supply channel for supplying air into the gap;

continuously suctioning air through the air suction channel from the gap; and adjusting the supplied air and the suctioned air while the support surface is moving in the advancing direction such that a parabolic air flow velocity profile is developed in the gap and the velocity profile has a point located at a radial distance from the surface of the support and from the side of the body facing into the gap where the air velocity is 0.

9. The method of claim 8, wherein the velocity profile is calculated according to the Hagen-Poiseuille formula.

* * * * *